US011491671B2

(12) United States Patent
Canelon

(10) Patent No.: US 11,491,671 B2
(45) Date of Patent: Nov. 8, 2022

(54) SPATULA EDGE TRIMMING APPARATUS

(71) Applicant: Ramon Canelon, Miami, FL (US)

(72) Inventor: Ramon Canelon, Miami, FL (US)

( * ) Notice: Subject to any disclaimer, the term of this patent is extended or adjusted under 35 U.S.C. 154(b) by 875 days.

(21) Appl. No.: 16/387,212

(22) Filed: Apr. 17, 2019

(65) Prior Publication Data

US 2020/0331110 A1 Oct. 22, 2020

(51) Int. Cl.
*B26D 1/04* (2006.01)
*B26D 5/08* (2006.01)
*B26D 7/00* (2006.01)

(52) U.S. Cl.
CPC ..... *B26D 1/04* (2013.01); *B26D 5/086* (2013.01); *B26D 7/0006* (2013.01)

(58) Field of Classification Search
CPC .... B24D 15/06; B24D 15/063; B24D 15/065; B24D 15/08; B26D 1/04; B26D 1/06; B24B 3/36; B24B 3/54; Y10T 83/8847; Y10T 83/2216; Y10T 83/2092; Y10T 83/2209
See application file for complete search history.

(56) References Cited

U.S. PATENT DOCUMENTS 602,273 A 4/1898 Shuster
1,190,718 A 7/1916 Johnson
2,790,339 A 4/1957 Brink
4,498,360 A 2/1985 Milum
5,105,703 A * 4/1992 Kondo ..... B41J 11/70 83/636
5,636,556 A 6/1997 Friedlander
6,152,007 A * 11/2000 Sato ..... B26D 1/085 83/636
6,848,983 B2 2/2005 Gallegos
7,676,933 B2 3/2010 Chun

FOREIGN PATENT DOCUMENTS

EP 0039532 A1 * 11/1981

* cited by examiner

*Primary Examiner* — Jennifer S Matthews

(57) ABSTRACT

A spatula edge trimming apparatus for re-edging a spatula includes a base housing with the front side having a spatula receptacle slot extending through to the cavity. The bottom side has a drop aperture extending through to the cavity. The spatula receptacle slot is configured to receive a spatula. A cutter is coupled to the base housing within the cavity and is configured to cut an edge of the spatula. A drive is coupled to the top side of the base housing and is in operational communication with the cutter. A plurality of controls is coupled to the base housing and is in operational communication with the drive. A power source is coupled to the housing. The power source is in operational communication with, and provides power to, each of the drive and the plurality of controls.

8 Claims, 5 Drawing Sheets

SPATULA EDGE TRIMMING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to spatula sharpeners and more particularly pertains to a new spatula sharpener for re-edging a spatula.

BRIEF SUMMARY OF THE INVENTION

An embodiment of the disclosure meets the needs presented above by generally comprising a base housing having a front side separated from a back side, a left side separated from a right side, and a bottom side separated from a top side. The front side, the back side, the left side, the right side, the top side and the bottom side form a cavity. The front side has a spatula receptacle slot extending through to the cavity. The bottom side has a drop aperture extending through to the cavity. The spatula receptacle slot is configured to receive a spatula. A cutting means is coupled to the base housing within the cavity. The cutting means is configured to cut an edge of the spatula. A drive means is coupled to the top side of the base housing. The drive means is in operational communication with the cutting means. A plurality of controls is coupled to the base housing and is in operational communication with the drive means. A power source is coupled to the housing. The power source is in operational communication with, and provides power to, each of the drive means and the plurality of controls.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
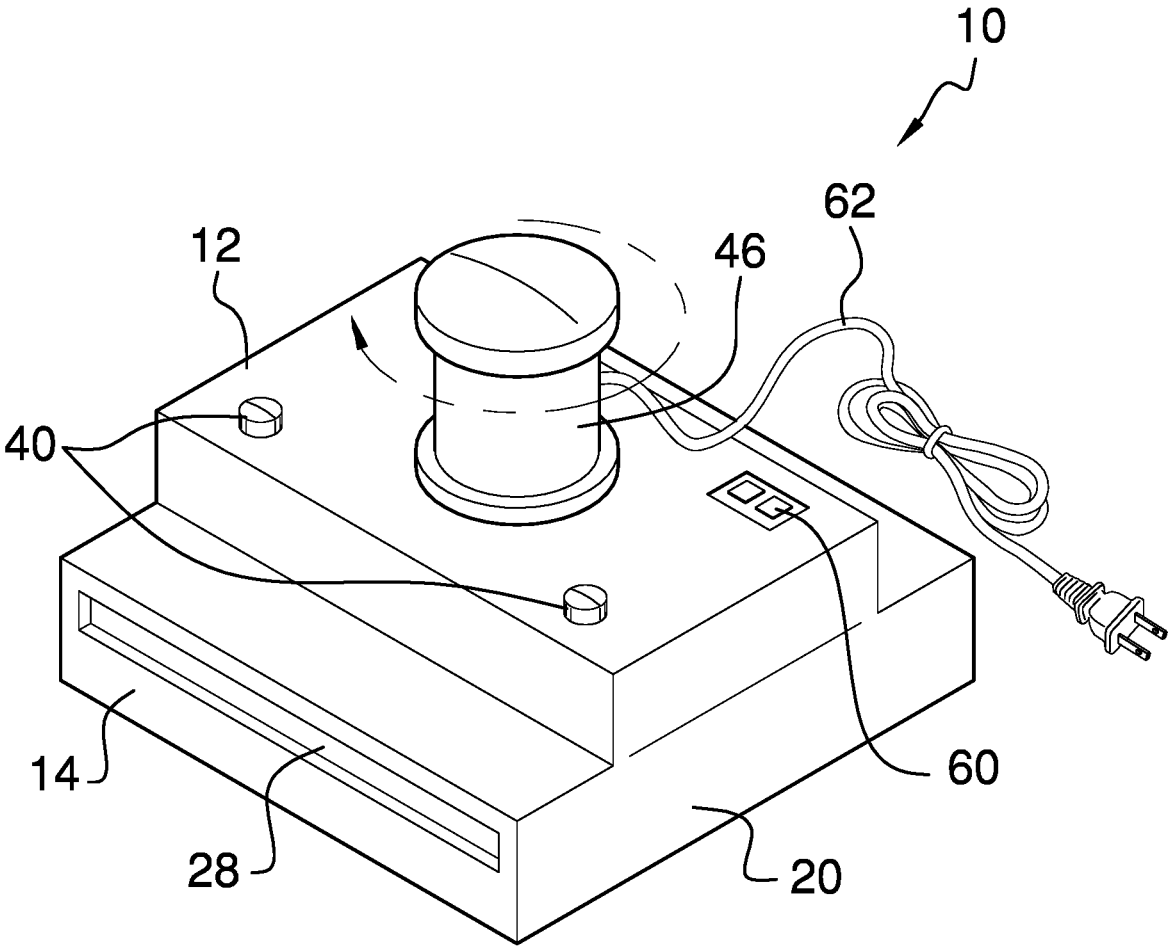
FIG. 1 is an isometric view of a spatula edge trimming apparatus according to an embodiment of the disclosure.
Figure 2:
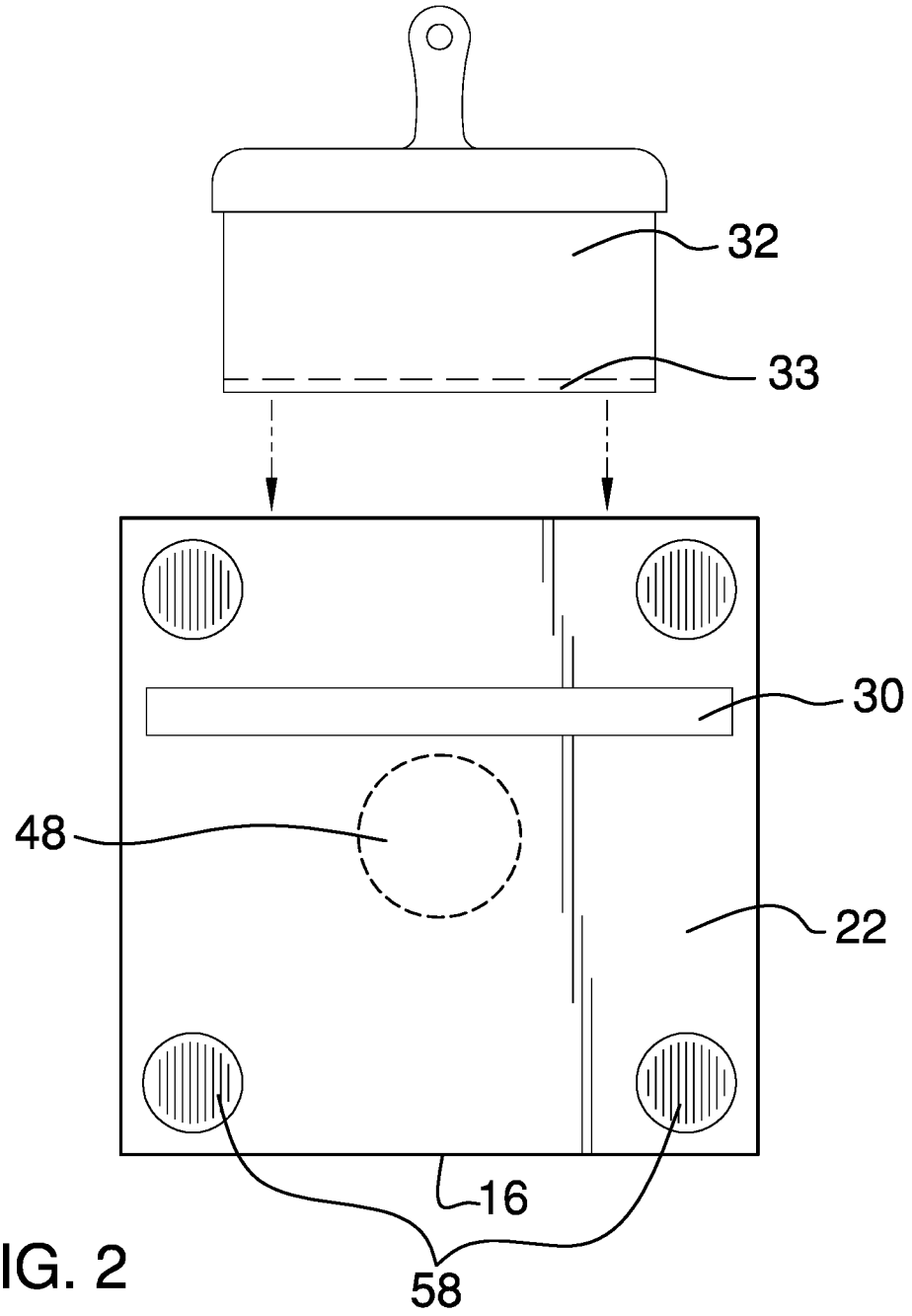
FIG. 2 is a bottom plan view of an embodiment of the disclosure.
Figure 3:
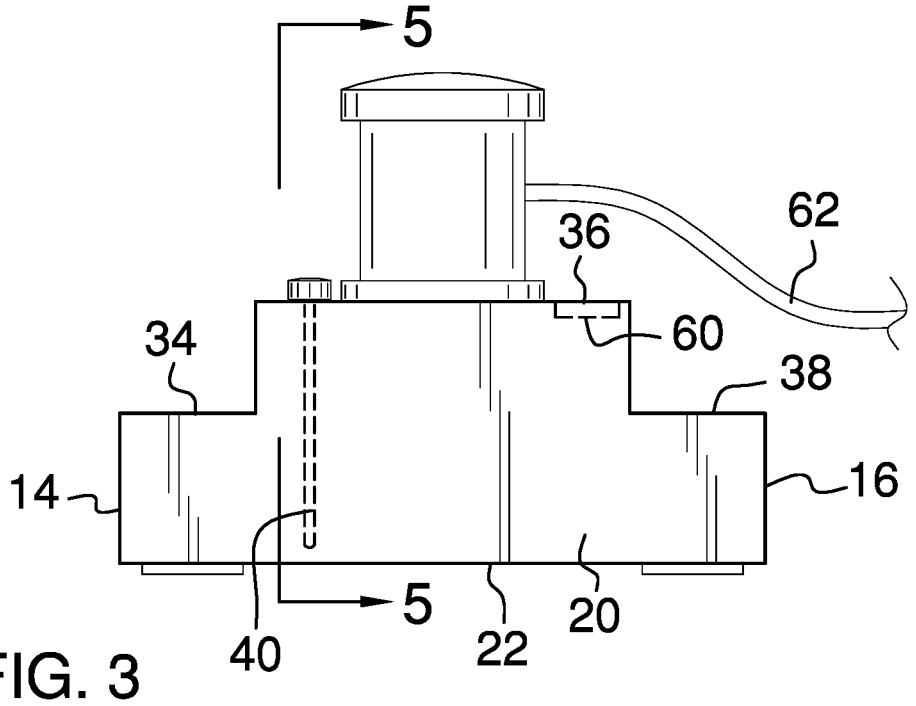
FIG. 3 is a side elevation view of an embodiment of the disclosure.
Figure 4:
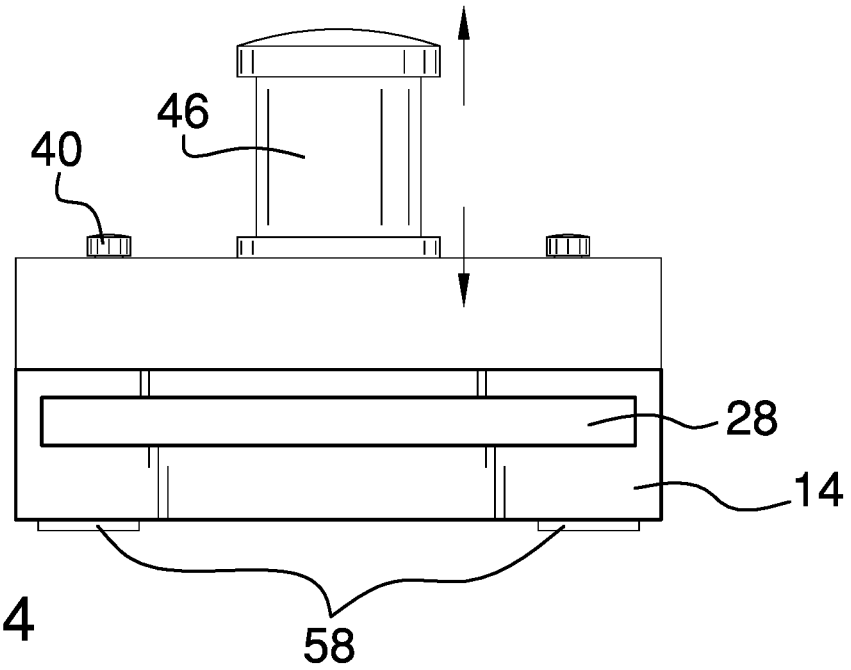
FIG. 4 is a front elevation view of an embodiment of the disclosure.
Figure 5A:
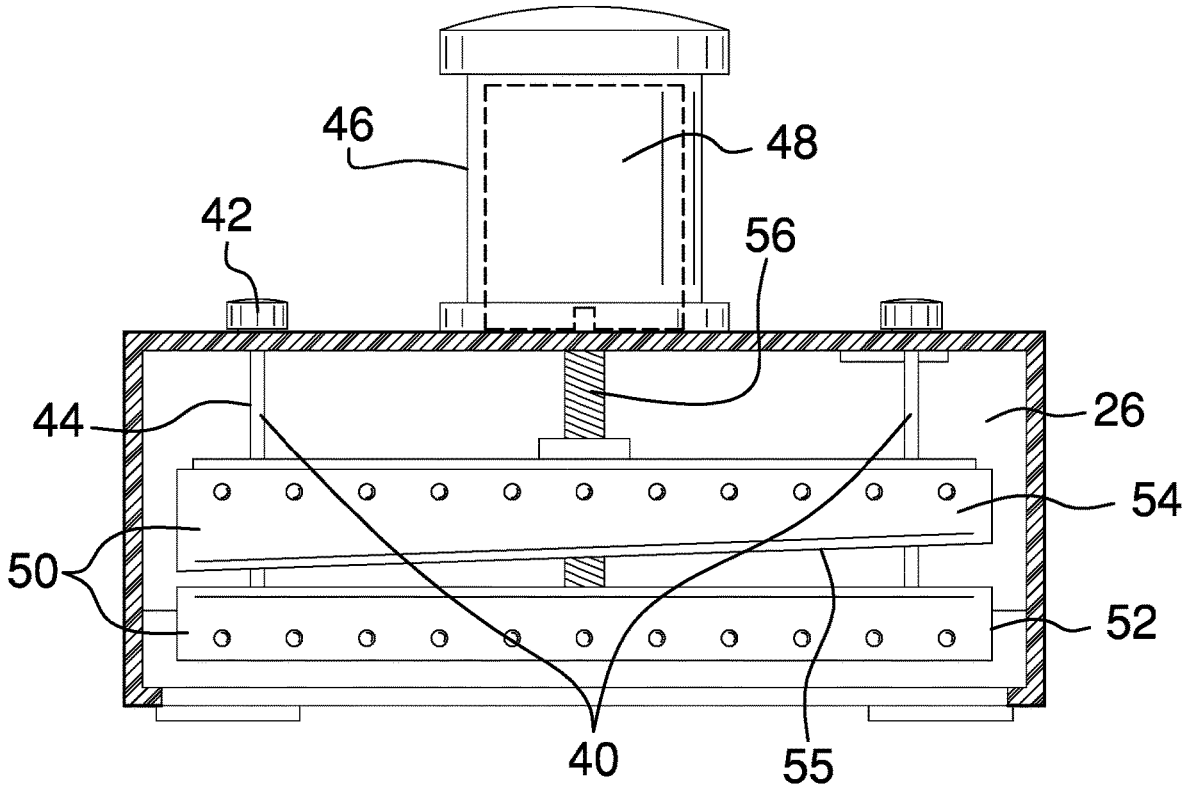
FIG. 5A is a cross-sectional view of an embodiment of the disclosure along line 5-5 of FIG. 3.
Figure 5B:
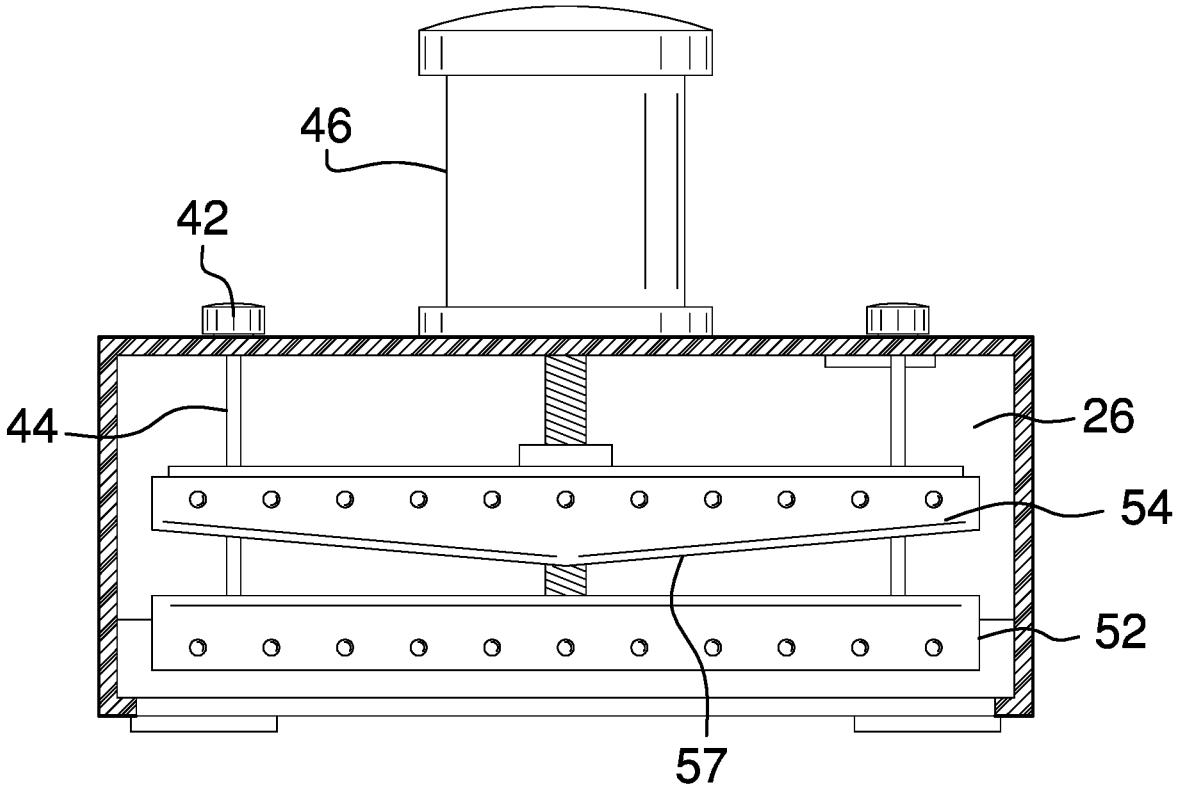
FIG. 5B is a cross-sectional view of an embodiment of the disclosure along line 5-5 of FIG. 3.

With reference now to the drawings, and in particular to FIGS. 1 through 5B thereof, a new spatula sharpener embodying the principles and concepts of an embodiment of the disclosure and generally designated by the reference numeral 10 will be described.

As best illustrated in FIGS. 1 through 5B, the spatula edge trimming apparatus 10 generally comprises a base housing 12 having a front side 14 separated from a back side 16, a left side 18 separated from a right side 20, and a bottom side 22 separated from a top side 24. The front side 14, the back side 16, the left side 18, the right side 20, the top side 24 and the bottom side 22 form a cavity 26. The front side 14 has a spatula receptacle slot 28 extending through to the cavity 26. The bottom side 22 has a drop aperture 30 extending through to the cavity 26. The spatula receptacle slot 28 is configured to receive a spatula 32. The top side 24 may have a front tier 34, middle tier 36, and a rear tier 38. The middle tier 36 is elevated above each of the front tier 34 and the rear tier 38. The front tier 34 and the rear tier 38 are coplanar.

A pair of guide pins 40 is coupled to the base housing 12. The pair of guide pins 40 extends through the middle tier 36 of the top side 24 of the base housing 12. Each of the pair of guide pins 40 may comprise a pin head 42 and a shaft 44. The pin head 42 is coupled adjacent the top side 24 of the base housing 12 and the shaft 44 extends to the bottom side 22 of the base housing 12. A motor housing 46 is coupled to the middle tier 36 of the top side 24 of the base housing 12 and extends through into the cavity 26. A motor 48 is coupled within the motor housing 46.

A pair of blades 50 is coupled to the pair of guide pins 40. The pair of blades 50 comprises a base blade 52 coupled to the pair of guide pins 40 adjacent the bottom side 22 of the base housing 12 and a cutting blade 54 slidably coupled to the pair of guide pins 40 above the base blade 52. An endless screw 56 is coupled to the motor 48 and is in operational communication with the motor 48. The cutting blade 54 is coupled to the endless screw 56. The motor 48 rotates the endless screw 56 to move the cutting blade 54 up and down the pair of guide pins 40. The cutting blade 54 may have a single tapered edge 55 or a pointed edge 57.

A plurality of feet 58 is coupled to the bottom side 22 of the base housing 12 and is configured to raise the base housing 12 above a surface. A plurality of controls 60 is coupled to the top side 24 of the housing 12 and extends through to the cavity 26. The plurality of controls 60 is in operational communication with the motor 48. A power source 62 is coupled to the housing 12 within the cavity 26. The power source 62 is in operational communication with, and provides power to, each of the motor 48 and the plurality of controls 60.

The base housing 12 may be coupled within a kiosk machine to require payment to operate the plurality of controls 60.

In use, a spatula 32 is inserted in the spatula receptacle slot 28 and the plurality of controls 60 is used to activate the motor 48. The motor 48 rotates the endless screw 56 to move the cutting blade 54 down to cut off an edge 33 of the spatula 32 between the cutting blade 54 and the base blade 52. The trimmed edge 33 then falls through the drop aperture 30 to be collected. The motor 48 then reverses the endless screw 56 to move the cutting blade 54 back up and the spatula 32 is withdrawn and ready for use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spatula edge trimming apparatus comprising:

a base housing having a front side separated from a back side, a left side separated from a right side, and a bottom side separated from a top side, the front side, the back side, the left side, the right side, the top side and the bottom side forming a cavity, the front side having a spatula receptacle slot extending through to the cavity, the bottom side having a drop aperture extending through to the cavity, the spatula receptacle slot being configured to receive a spatula;

a cutting means coupled to the base housing, the cutting means being coupled within the cavity, the cutting means being configured to cut an edge of the spatula;

a drive means coupled to the base housing, the drive means being coupled to the top side, the drive means being in operational communication with the cutting means;

a plurality of controls coupled to the base housing, the plurality of controls being in operational communication with the drive means; and a power source coupled to the housing, the power source being in operational communication with, and providing power to, each of the drive means and the plurality of controls.

2. The spatula edge trimming apparatus of claim 1 further comprising the cutting means comprising:

a pair of guide pins coupled to the base housing, the pair of guide pins being coupled within the cavity; and a pair of blades coupled to the pair of guide pins, the pair of blades comprising a base blade being coupled to the pair of guide pins adjacent the bottom side of the base housing and a cutting blade being slidably coupled to the pair of guide pins above the base blade.

3. The spatula edge trimming apparatus of claim 2 further comprising the drive means comprising:

a motor housing coupled to the base housing, the motor housing being coupled to the top side of the base housing and extending into the cavity;

a motor coupled to the motor housing, the motor being coupled within the motor housing; and an endless screw coupled to the motor, the endless screw being in operational communication with the motor, the cutting blade being coupled to the endless screw, the motor rotating the endless screw to move the cutting blade up and down the pair of guide pins.

4. The spatula edge trimming apparatus of claim 2 further comprising the pair of guide pins extending through the top side of the base housing, each of the pair of guide pins having a pin head and a shaft, the pin head being coupled adjacent the top side of the base housing and the shaft extending to the bottom side of the base housing.

5. The spatula edge trimming apparatus of claim 2 further comprising the pair of blades, the cutting blade being tapered.

6. The spatula edge trimming apparatus of claim 1 further comprising the top side having a front tier, middle tier, and a rear tier, the middle tier being elevated above each of the front tier and the rear tier, the front tier and the rear tier being coplanar.

7. The spatula edge trimming apparatus of claim 1 further comprising a plurality of feet coupled to the base housing, the plurality of feet being coupled to the bottom side of the base housing, the plurality of feet being configured to raise the base housing above a surface.

8. A spatula edge trimming apparatus comprising:

a base housing having a front side separated from a back side, a left side separated from a right side, and a bottom side separated from a top side, the front side, the back side, the left side, the right side, the top side and the bottom side forming a cavity, the front side having a spatula receptacle slot extending through to the cavity, the bottom side having a drop aperture extending through to the cavity, the spatula receptacle slot being configured to receive a spatula, the top side having a front tier, middle tier, and a rear tier, the middle tier being elevated above each of the front tier and the rear tier, the front tier and the rear tier being coplanar;

a pair of guide pins coupled to the base housing, the pair of guide pins extending through the middle tier of the top side of the base housing, each of the pair of guide pins having a pin head and a shaft, the pin head being coupled adjacent the top side of the base housing and the shaft extending to the bottom side of the base housing;

a motor housing coupled to the base housing, the motor housing being coupled to the middle tier of the top side of the base housing and extending through into the cavity;

a motor coupled to the motor housing, the motor being coupled within the motor housing;

a pair of blades coupled to the pair of guide pins, the pair of blades comprising a base blade being coupled to the pair of guide pins adjacent the bottom side of the base housing and a cutting blade being slidably coupled to the pair of guide pins above the base blade;

an endless screw coupled to the motor, the endless screw being in operational communication with the motor, the cutting blade being coupled to the endless screw, the motor rotating the endless screw to move the cutting blade up and down the pair of guide pins;

a plurality of feet, the plurality of feet being coupled to the bottom side of the base housing, the plurality of feet being configured to raise the base housing above a surface;

a plurality of controls coupled to the housing, the plurality of controls being coupled to the top side of the housing and extending through to the cavity, the plurality of controls being in operational communication with the motor; and a power source coupled to the housing, the power source being coupled within the cavity, the power source being in operational communication with, and providing power to, each of the motor and the plurality of controls.

* * * * *